US005439346A

United States Patent [19]

Bowser et al.

[11] Patent Number: 5,439,346

[45] Date of Patent: Aug. 8, 1995

[54] PNEUMATIC PRESSURE AUTOMATIC BRAKING MECHANISM

[75] Inventors: Gregory A. Bowser, Boynton Beach; Edward C. McCollough, Lantana, both of Fla.

[73] Assignee: Air Turbine Technology, Inc., Boca Raton, Fla.

[21] Appl. No.: 122,375

[22] Filed: Sep. 16, 1993

[51] Int. Cl.[6] ..... F01D 1/34

[52] U.S. Cl. ..... 415/18; 415/26; 415/82; 415/123

[58] Field of Search ..... 415/18, 26, 82, 123, 415/904

[56] References Cited

U.S. PATENT DOCUMENTS

| | | | |
|---|---|---|---|
| 3,052,984 | 9/1962 | Mitthauser et al. | 415/123 |
| 3,128,079 | 4/1964 | Groff | 415/123 |
| 3,132,426 | 5/1964 | White | 415/123 |
| 3,270,417 | 9/1966 | Stram | 415/18 |
| 3,712,386 | 1/1973 | Peters | 415/123 |
| 3,945,757 | 3/1976 | Cummens | 415/123 |
| 4,141,671 | 2/1979 | Tarsoly | 415/123 |
| 4,776,752 | 10/1988 | Davis | 415/82 |
| 5,186,603 | 2/1993 | Kishi | 415/82 |

*Primary Examiner*—Edward K. Look
*Assistant Examiner*—James A. Larson
*Attorney, Agent, or Firm*—Curtis Morris & Safford; Barry Evans

[57] ABSTRACT

A braking mechanism for a rotary apparatus having a housing adapted to receive a pressurized fluid and a rotor rotatably mounted in the housing. The braking mechanism enables the rotor to rotate in the housing in response to the receipt of the pressurized fluid and inhibits the rotor from rotating in the absence of the receipt of the pressurized fluid.

13 Claims, 4 Drawing Sheets

PNEUMATIC PRESSURE AUTOMATIC BRAKING MECHANISM

BACKGROUND OF THE INVENTION

1. Field of the Invention

This invention relates to an automatic braking system and, more particularly, to an automatic braking system for use with a rotary apparatus.

2. Description of the Prior Art

In the prior art, braking systems for rotary devices, such as turbine powered rotary devices, utilize one or more rods which press against a brake disk attached to the rear portion of the rotary device. The friction produced by the rod(s) pressing against the braking disk causes the disk and a rotating rotor to stop rotating. Movement of such rod(s) may be controlled by a valve member which also controls the flow of compressed air into the rotary device.

For example, consider the air motor described in U.S. Pat. No. 5,186,603. As described therein, the air motor generally includes a front housing, a rear housing which is fitted to a rear portion of the front housing, a rear cap coupled to the rear portion of the front housing, and a valve sleeve which is slidably fitted to an outer periphery of a small-diameter rear portion of the rear housing. A valve inside cylinder having a supply port for receiving compressed air is fitted into the valve sleeve. A rotor is installed in a rotor chamber formed by the inside rear portion of the front housing and a front portion of the rear housing. The rotor is coupled to one end of a rotary shaft to which the other end may be coupled to a grinding tool.

A brake disk is secured to the rear surface of a rear portion of the rotor. A brake rod(s) is linked with the valve outside sleeve so as to be movable therewith.

The valve sleeve may be moved in an axial direction by turning an external thread formed on an outer periphery of the front portion of the valve sleeve against an internal thread of the rear cap. When the valve sleeve is maximally withdrawn or moved in one direction, the rear housing is separated from the valve inside sleeve so as to open a fluid channel in the valve inside cylinder and enable compressed air to flow to the rotor, thus causing the rotor to rotate. On the other hand, when the valve sleeve is moved in the other direction so as to close the fluid channel, the flow of compressed air is stopped. Additionally, in this latter situation, the brake rod(s) is moved so as to be pressed against the brake disk, thereby exerting a frictional force upon the rotating rotor so as to cause the rotor to stop rotating.

Thus, in such air motors, the valve sleeve or member, which is utilized for controlling the flow of compressed air to the rotor, is mechanically linked to a brake rod(s) so as to control the movement thereof and is located at the rear of the air motor. As is to be appreciated, such arrangement limits the placement of such valve member in the rotary device.

OBJECTS AND SUMMARY OF THE INVENTION

An object of the present invention is to provide a rotary device having a braking mechanism which overcomes the problems associated with the prior art.

More specifically, it is an object of the present invention to provide a rotary device powered by a flow of compressed fluid having a braking mechanism which is activated in the absence of the flow of compressed fluid to stop a rotor in the rotary device from rotating and to inhibit such rotor from further rotation.

Another object of the present invention is to provide a rotary device as aforementioned in which the braking mechanism is not coupled to a valve utilized for controlling the flow of compressed fluid.

It is still another object of the present invention to provide a rotary device as aforementioned in which the location of the valve for controlling the flow of compressed fluid is not limited to a rear portion of the rotary device.

In accordance with an aspect of this invention, a rotary apparatus is provided which comprises a housing adapted to receive a pressurized fluid; a rotor rotatably mounted in the housing; and braking means for enabling the rotor to rotate in the housing in response to the receipt of the pressurized fluid and for inhibiting the rotor from rotating in the absence of the receipt of the pressurized fluid.

Other objects, features and advantages according to the present invention will become apparent from the following detailed description of the illustrated embodiment when read in conjunction with the accompanying drawings in which corresponding components are identified by the same reference numerals.

DETAILED DESCRIPTION OF THE PREFERRED EMBODIMENT

Figure 1:
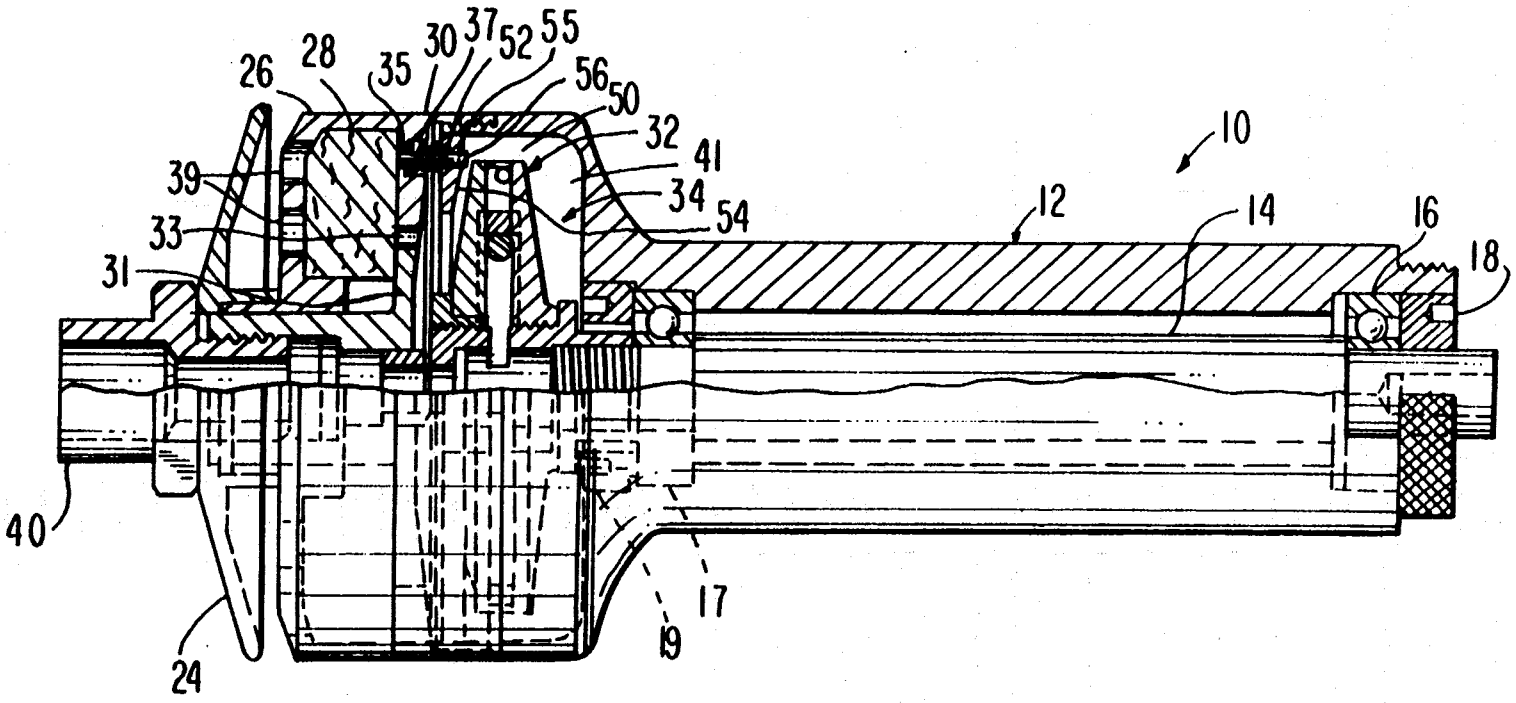
FIG. 1 is a longitudinal sectional view of a rotary apparatus according to an embodiment of the present invention.

FIG. 1 illustrates a rotary apparatus 10 which utilizes a braking mechanism 50 according to the embodiment of the present invention. The preferred embodiment of the present invention will be described for use with a reaction turbine-type motor, such as that described in U.S. Pat. No. 4,776,752 to Davis, which has a common assignee with the present invention and the disclosure of which is hereby incorporated by reference. However, the present invention is not so limited and may be applied to rotary apparatus having other types of motors.

As shown in FIG. 1, the rotary apparatus 10 generally includes a housing 12, an end cap 30, a motor 41, a rotatable shaft 14, and the braking mechanism 50. The housing 12 includes a portion having a relatively large diameter to which the end cap 30 is coupled by, for example, threading the end cap onto the housing. Attached to the end cap 30 is a muffler housing 26 having a muffler 28 contained therein. The muffler 28, which may be composed of a felt-like material, is adapted for muffling the noise caused by exhausted fluids. A deflector 24 is coupled to the muffler housing 26 and is adapted to deflect the stream of exhausted fluids from the muffler housing 26. The portion of the housing 12 having the relatively large diameter includes a motor chamber 34 formed on an inside portion thereof. The motor 41, which includes a rotatable turbine rotor 32, is mounted in the motor chamber 34. The rotatable shaft 14 is attached at one end to the motor 41 and at the other end to a tool (not shown), such as a grinding-type tool. The shaft 14 is rotatably supported by bearings 16 and 17 which, in turn, are respectively secured to the housing 12 by bearing retaining members 18 and 19.

The end cap 30 includes a plate-like portion 31 having one or more holes 33 each having a predetermined diameter which are adapted to allow the pressurized fluid to escape from the motor chamber 34, as hereinafter more fully described. The plate-like portion 31 further includes one or more holes 35 in which a guide pin 56 is respectively secured therein by, for example, press-fitting or similar such means. Each of the guide pin(s) 56 extends from the plate-like member 31 into the motor chamber 34. Each of the holes 35 includes a counterbore-like or larger diameter portion 37 located at the side of the plate-like portion 31 which faces the turbine rotor 32.

The braking mechanism 50 is located inside the motor chamber 34. More specifically, a spring 52, such as a compression-type spring, is placed over each guide pin 56 in the plate-like portion 31 of the end cap 30 so as to rest in the respective counterbore-like portion 37. A brake pad 54 having a number of guide holes 55, which are adapted to guide the brake pad during movement as hereinafter described, is arranged such that the guide hole(s) receive the guide pins 56. That is, the number of guide holes 55 respectively correspond to the guide pins 56 and have a number which equals the number of guide pins. The guide hole(s) 55 in the brake pad 54 are preferably slightly larger than the diameter of the guide pin(s) 56 and, accordingly may readily accommodate the guide pin(s). The brake pad 54 is arranged such that the guide hole(s) 55 respectively receive the guide pin(s) 56 and each spring 52 contacts against the side of the brake pad which faces the plate-like member 31. The brake pad is further arranged within the motor chamber 34 so as to be adjacent to the rotor 32. As a result, the brake pad may be moved in a direction substantially parallel to a longitudinal axis of the guide pin(s) 56. For example, due to the force exerted on the brake pad 54 by each spring 52, the brake pad may be moved in such direction until the brake pad contacts the rotor 32.

In a preferred embodiment, the plate-like member 31 of the end cap 30 includes four equally spaced holes 35 arranged in a circular pattern, four corresponding counterbore-like portions 37, and four guide pins 56 respectively secured into the holes 35. In such embodiment, four springs 52 are respectively placed over the guide pins 56, and the brake pad 54 includes four holes 55 which correspond to the guide pins.

A compressed fluid, such as compressed air, is supplied to the rotary device 10 from a supply (not shown) by way of an inlet 40.

As previously mentioned, the motor 41 in the rotary apparatus 10 and, as such, the motor used in describing the present invention is a reaction turbine-type motor such as the type described in U.S. Pat. No. 4,776,752 to Davis. Such reaction turbine-type motor 41 as in the Davis patent is actuated by pressurized fluid and is capable of relatively precise speed control.

Figure 4:
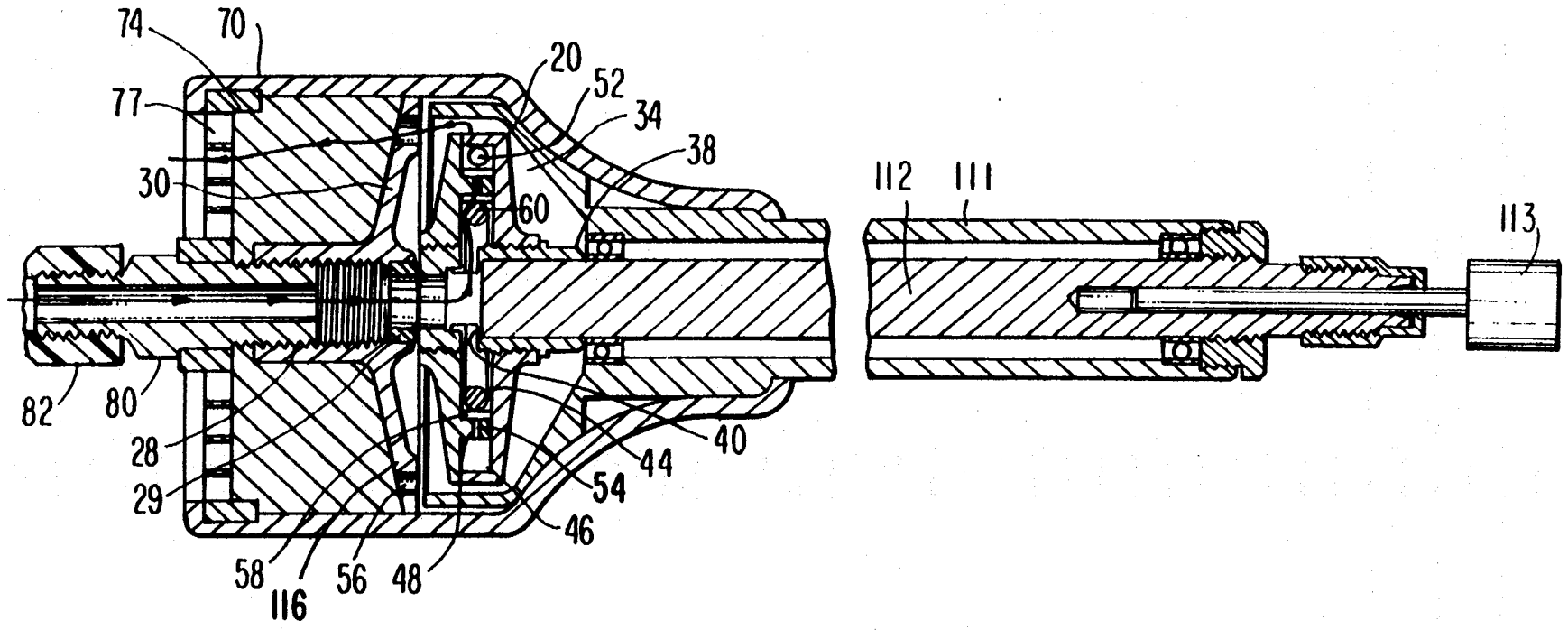
FIG. 4 (PRIOR ART)
FIG. 4 illustrates a cross-sectional side view of a reaction turbine-type motor.

As described in one preferred embodiment for a reaction turbine-type motor in accordance with the Davis patent and as illustrated in FIG. 4 herein, such motor generally comprises: an elongated forward housing 111; a rearward housing 116; a rotatable drive shaft means 112; and a turbine rotor 20. In operation, a pressurized fluid flow is directed into an inlet adapter 80 from a flexible hose 82, through inlet adapter 80, connected cylindrical pressurized fluid inlet portion 28, and sealing ring 29 into a third counterbore at the rear of a turbine rotor coupler 38. The flow then goes radially outwardly from a second midpoint counterbore portion of the turbine rotor coupler 38 through diametrically opposed radial openings 40. Here the pressurized flow passes out of a first annular chamber 44 around resilient value ring 60 and through grooves 58 to radial holes 54 into a second annular chamber 46 where it is directed through nozzles 52, thereby imparting rotation to a rotatable drive shaft means 12 and grinding wheel 113. The pressurized fluid then passes into cylindrical chamber 34 where it exits through exit opening 56, in outwardly extending flange portion 30 of rearward housing 116, into the muffling housing 70 where the exhaust nozzle is muffled, and the exhausted flow then exits through openings 77 through the rear holding plate 76 to atmosphere. As a pressurized fluid, such as compressed air, is directed into inlet adapter 80 at a selected p.s.i., rotation increases to a preselected maximum; centrifugal forces acting on resilient valve ring 60 tend to cause radial expansion of said ring 60. However, the inner surface of the annular wall 48 supports valve ring 60, except at grooves 58. This enables the radial expansion of the valve ring 60 to be directed into the grooves 58 so as to cause a controlled elastic deformation of valve ring 60. By this construction, flow can be essentially unrestricted until valve ring 60 comes into relatively close proximity to radial holes 54. By this construction, forces acting on the elastic material are of sufficient magnitude as to cause pressure differential between radial holes 54 and the first annular chamber 44 to be relatively insignificant to operation, allowing smooth operation. In operation, as the resilient valve ring 60 deforms, it approaches the ends of radial holes 54. As the distance narrows sufficiently, fluid flow through the radial holes 54 is restricted and rotating forces reduced. As drag forces acting on the system and rotating forces reach equilibrium, the forces acting on the resilient valve ring 60, namely centrifugal forces, centripetal forces, pressure differential forces across the ring, and the resilient forces acting to return the elastic material to its original configuration, will also be in equilibrium. This results in a constant rotary speed. If drag forces increase, the equilibrium would be disrupted, and the resilient valve ring 60 resilient forces will retract the valve ring 60 from its closest proximity to radial holes 54, allowing additional fluid flow until another equilibrium is established. If for any reason the turbine should exceed the desired governed speed, the resilient valve ring 60 will move to restrict pressure fluid flow even further until sufficient overspeed will cause all flow to stop, thereby incorporating an overspeed safety.

Basically, with the exception of the braking mechanism 50, end cap 30 and the deflector 24, and relatively minor modifications to the housing 12 and muffler housing 26, the rotary apparatus 10 of FIG. 1 is substantially similar to and operates in a substantially similar manner as that of FIG. 4 and, accordingly further discussion relating to these similar features is omitted herein. A description of such braking mechanism 50, end cap 30 and deflector 24 was previously presented. However, an operating description of these elements will now be presented.

In the rotary apparatus 10 of FIG. 1, as with the rotary device of FIG. 4, compressed fluid enters the rotary apparatus by way of the inlet 40 and is supplied therefrom to the motor 41 and turbine rotor 32. From the turbine rotor 32, the compressed fluid is supplied into the motor chamber 34, whereupon the fluid exits or is exhausted through the holes 33 in the plate-like member 31 of the end cap 30, the muffler 28, and holes 39 in the muffler housing 26 to the outside. Such exhausted fluid is deflected by the deflector 24 so as to avoid the operator of the rotary apparatus 10.

Figure 2:
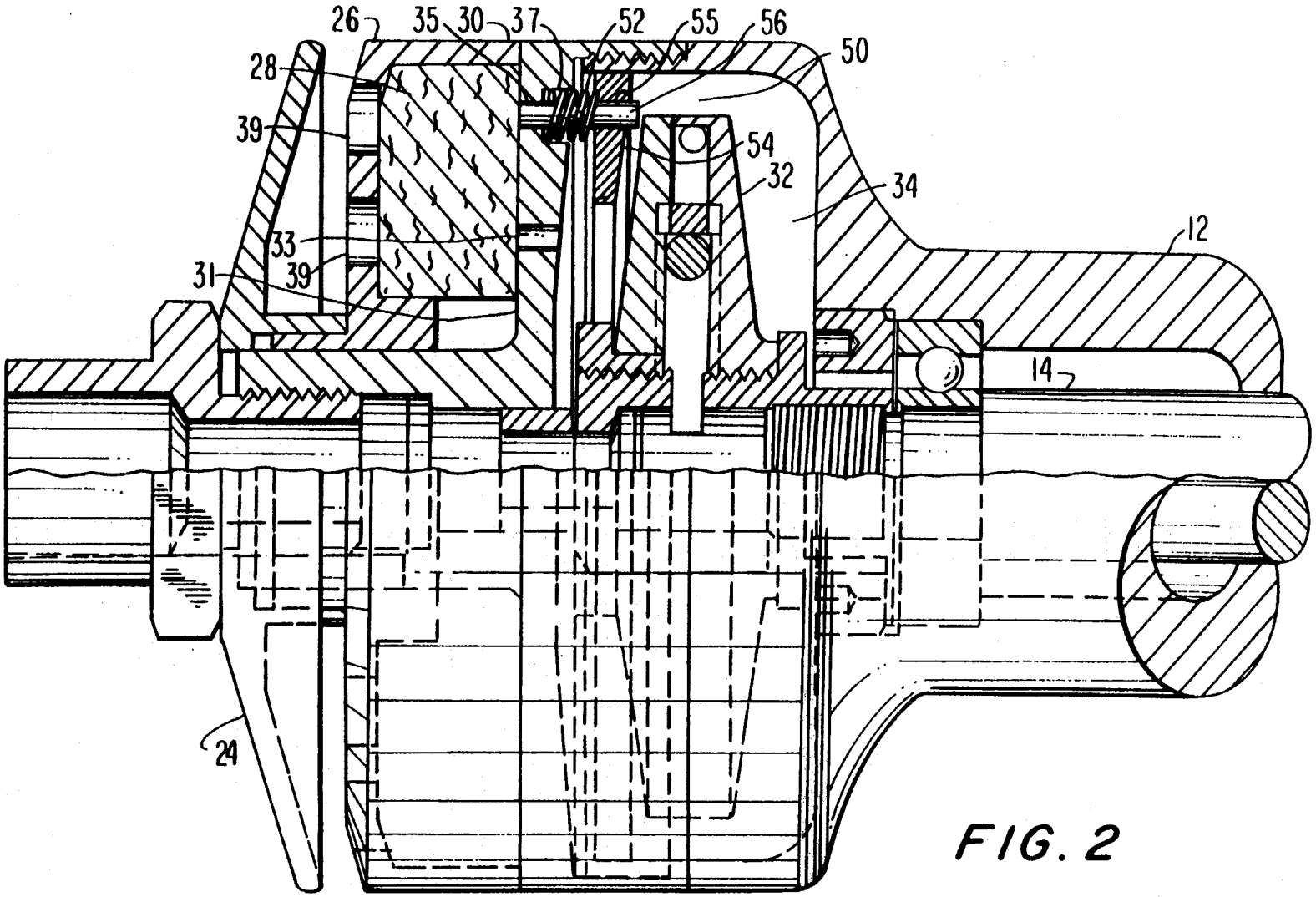
FIG. 2 is an exploded partial sectional view of the rotary apparatus of FIG. 1 illustrating the position of a braking mechanism when compressed fluid is flowing into the rotary apparatus.

The flow of the compressed fluid into and out of the motor chamber 34 as previously described creates a relatively high exhaust pressure therein, which is greater than the pressure normally present within the motor chamber in the absence of the flow of the compressed fluid. Such high exhaust pressure exerts a force upon the brake pad 54 which is larger than the force exerted on the brake pad by the springs 52. As a result and as shown in FIG. 2, the brake pad 54 is caused to move in a direction away from the rotor 32 such that the brake pad does not contact the rotor. Such movement of the brake pad 54 is guided by the guide pins 56 in the guide holes 55.

The size and the number of holes 33 in the end cap 30, the number of springs 52 and the characteristics thereof, the muffler 28, and the size and number of holes 39 in the muffler housing 26, are selected so as to enable the brake pad 54 to move away from the rotor 32 when the desired compressed fluid having a desired flow rate is supplied to the rotary apparatus 10 as previously described.

Figure 3:
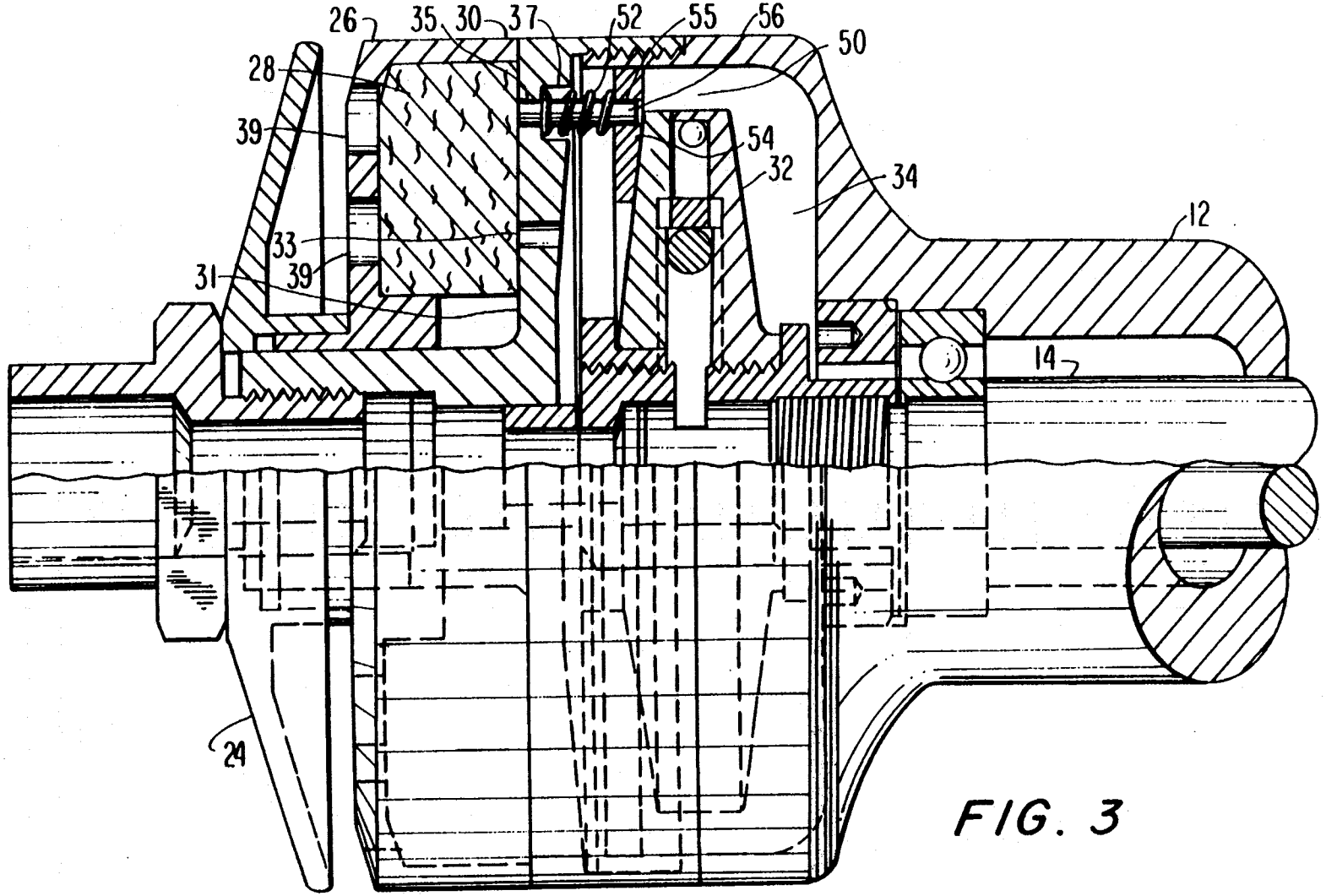
FIG. 3 is an exploded partial sectional view of the rotary apparatus of FIG. 1 illustrating the position of the braking mechanism when compressed fluid is not flowing into the rotary apparatus.

On the other hand, when the compressed fluid is not supplied to the rotary apparatus 10, a relatively large exhaust pressure is not created in the motor chamber 34. Accordingly, a force is not exerted on the brake pad 54 which overcomes the force exerted thereon by the springs 52. As a result and as shown in FIG. 3, the force exerted on the brake pad 54 by the springs 52 causes the brake pad to move so as to contact the rotor 32. Such contact on the rotor by the brake pad causes a frictional force to be applied thereto, thereby stopping the rotor 32 from rotating and inhibiting further rotation thereof. Further, as in the situation described with reference to FIG. 2, the movement of the brake pad 54 is guided by the guide pins 56 in the guide holes 55.

Thus, when no compressed fluid is supplied to the rotary apparatus 10, the braking mechanism 50 automatically contacts the rotor 32 so as to stop the rotation thereof and inhibit any further rotation thereof. On the other hand, when compressed fluid is supplied to the rotary apparatus, a relatively large exhaust pressure is created within the rotary apparatus which automatically causes the brake pad 54 to move away from the rotor 32 so as not to be in contact with the rotor, thereby enabling the rotor to rotate in response to the received compressed fluid.

Since the braking mechanism 50 is not mechanically linked or coupled to a fluid control valve (not shown), which controls the flow of the compressed fluid into the rotary apparatus 10, as in the conventional rotary apparatus as previously described, the fluid control valve may be located other than at the rear portion of the rotary apparatus as in the conventional rotary apparatus. With the present braking mechanism, such fluid control valve may even be activated by a device located remote from the rotary apparatus, such as by a foot petal.

Although the present embodiment has been described for use with a reaction turbine-type motor, the present invention is not so limited and may be applied to apparatus having other types of motors, as previously described. Further, although the compressed fluid is preferably compressed air, other fluids may also be utilized.

Although a preferred embodiment of the present invention and modifications thereof have been described in detail herein, it is to be understood that this invention is not limited to this precise embodiment and modifications, and that other modifications and variations may be affected by one skilled in the art without departing from the spirit and scope of the invention as defined by the appended claims.

What is claimed is:

1. A rotary apparatus comprising:

a housing adapted to receive a pressurized fluid and to discharge the received pressurized fluid so as to create an exhaust pressure;

a rotor mounted in said housing and being rotatable therein in response to the receipt of said pressurized fluid; and braking means, responsive to the absence of said exhaust pressure, for preventing said rotor from rotating.

2. A rotary apparatus comprising:

a housing adapted to receive a pressurized fluid and to discharge the received pressurized fluid so as to create an exhaust pressure;

a rotor rotatably mounted in said housing; and braking means for enabling said rotor to rotate in said housing in response to said exhaust pressure and for inhibiting said rotor from rotating in the absence of said exhaust pressure.

3. The rotary apparatus according to claim 2, wherein said pressurized fluid is compressed air.

4. The rotary apparatus according to claim 2, wherein said braking means includes a brake pad which, in response to said absence of said exhaust pressure, contacts said rotor so as to prevent said rotor from rotating and which, in response to said exhaust pressure, does not contact said rotor so as to enable said rotor to rotate.

5. The rotary apparatus according to claim 2, wherein said braking means includes a spring and a brake pad coupled thereto, said spring being compressed in response to said exhaust pressure so as to cause said brake pad to be moved so as not to contact said rotor thereby enabling said rotor to rotate and said spring being extended in the absence of said exhaust pressure so as to cause said brake pad to be moved so as to contact said rotor thereby inhibiting said rotor from rotating.

6. A rotary apparatus comprising:

a housing having an internal cavity and being adapted to receive a pressurized fluid into said internal cavity;

a rotor rotatably mounted in said internal cavity;

means for creating a predetermined exhaust pressure in said internal cavity upon the receipt of said pressurized fluid; and braking means, responsive to said predetermined exhaust pressure, for enabling said rotor to rotate in said internal cavity and, in the absence of said predetermined exhaust pressure, for inhibiting said rotor from rotating.

7. The rotary apparatus according to claim 6, wherein said pressurized fluid is compressed air.

8. The rotary apparatus according to claim 6, wherein said braking means includes a brake pad which, in response to said absence of said predetermined exhaust pressure, contacts said rotor so as to prevent said rotor from rotating and which, in response to said predetermined exhaust pressure, does not contact said rotor so as to enable said rotor to rotate.

9. The rotary apparatus according to claim 6, wherein said braking means includes a spring and a brake pad coupled thereto, said spring being compressed in response to said predetermined exhaust pressure so as to cause said brake pad to be moved so as not to contact said rotor thereby enabling said rotor to rotate and said spring being extended in the absence of said predetermined exhaust pressure so as to cause said brake pad to be moved so as to contact said rotor thereby inhibiting said rotor from rotating.

10. The rotary apparatus according to claim 6, wherein said means for creating includes a plate member having a predetermined number of holes each having a respective predetermined diameter.

11. A rotary apparatus comprising:

a housing adapted to receive a pressurized fluid and to discharge the received pressurized fluid so as to create an exhaust pressure;

a rotor rotatably mounted in said housing; and braking means for automatically enabling said rotor to rotate in said housing in response to said exhaust pressure and for automatically inhibiting said rotor from rotating in the absence of said exhaust pressure.

12. The rotary apparatus according to claim 11, wherein said pressurized fluid is compressed air.

13. In a reaction turbine-type motor having a housing adapted to receive a pressurized fluid and to discharge the received pressurized fluid so as to create an exhaust pressure, and a rotor mounted in said housing and being rotatable therein in response to the receipt of said pressurized fluid, the improvement comprising: braking means, responsive to the absence of said exhaust pressure, for automatically preventing said rotor from rotating.

* * * * *